US007798156B2

(12) United States Patent
Kelly

(10) Patent No.: US 7,798,156 B2
(45) Date of Patent: Sep. 21, 2010

(54) CARD TOOTHBRUSH

(76) Inventor: Robert Kelly, 1140 Cabrillo Ave., Burlingame, CA (US) 94010

( * ) Notice: Subject to any disclaimer, the term of this patent is extended or adjusted under 35 U.S.C. 154(b) by 0 days.

(21) Appl. No.: 11/353,411

(22) Filed: Feb. 13, 2006

(65) Prior Publication Data

US 2006/0191090 A1 Aug. 31, 2006

Related U.S. Application Data

(60) Provisional application No. 60/652,017, filed on Feb. 11, 2005.

(51) Int. Cl.
*A45D 44/18* (2006.01)
*A46B 1/00* (2006.01)
*A46B 7/02* (2006.01)

(52) U.S. Cl. ..... 132/308; 132/310; 15/187; 15/203

(58) Field of Classification Search ..... 132/308, 132/309, 311, 310; 15/185, 167.1, 184, 201–203, 15/202, 160, 159.1, 187
See application file for complete search history.

(56) References Cited

U.S. PATENT DOCUMENTS

| | | | | | |
|---|---|---|---|---|---|
| 1,307,530 | A * | 6/1919 | Wolf | 15/203 |
| 2,860,011 | A * | 11/1958 | Dunn | 300/21 |
| 3,707,013 | A * | 12/1972 | Erkers | 15/167.1 |
| 4,184,279 | A * | 1/1980 | Peilet | 40/314 |
| 4,482,263 | A * | 11/1984 | Palamara | 401/191 |
| 4,530,129 | A * | 7/1985 | Labick et al. | 15/184 |
| 5,074,414 | A * | 12/1991 | Romana | 206/362.4 |
| D322,893 | S * | 1/1992 | Kihara | D4/104 |
| 6,336,242 | B1 | 1/2002 | Tseng | |
| 6,643,887 | B1 * | 11/2003 | Foley et al. | 15/185 |
| 7,051,395 | B2 * | 5/2006 | Domke | 15/203 |
| 2004/0265038 | A1 | 12/2004 | Malki | |

FOREIGN PATENT DOCUMENTS

| | | |
|---|---|---|
| DE | 41 29 179 A1 | 3/1993 |
| EP | 0 235 671 B1 | 10/1990 |
| JP | 2-279109 A | 11/1990 |
| JP | 3-136607 A | 6/1991 |

* cited by examiner

*Primary Examiner*—Robyn Doan

(57) ABSTRACT

Brushcards are provided. The brushcards include a planar member having a plurality of sections, each separated by lines of weakness, each section having a handle region and a bristle region. The planar member includes at least one recess, and the member is configured to fold into a toothbrush.

11 Claims, 6 Drawing Sheets

CARD TOOTHBRUSH

RELATED APPLICATIONS

This Application claims the benefit of U.S. Application Ser. No. 60/652,017, filed Feb. 11, 2005 under 35 U.S.C. 119, and is incorporated by reference herein.

BACKGROUND OF THE INVENTION

Besides its cosmetic values, proper dental hygiene is essential to prevent disease and decay of the teeth, mouth, gums and surrounding areas. Devices and methods for optimum oral care are well known and established and few could argue against their value to society. Perhaps the most recognized oral care apparatus is the toothbrush, which has been a main stay in various shapes and forms for centuries. Many professionals in the dental care field agree that to be the most effective in preventing oral disease, a strict regimen of dental care should be followed. This schedule often includes regular brushing using a cleaning agent such as toothpaste several times a day. This routine in many instances is often preceded or followed by flossing to remove otherwise inaccessible particles of food or debris. Preferably brushing is done after each meal to remove the build up of tartar at the earliest possible opportunity. It is also advisable for aesthetic reasons to care for one's teeth prior to a meeting, conference or other social situation where one would like not only to present the best visual presence possible, but also to eliminate residue that may contribute to breath odor.

The problem with maintaining dental hygiene is that away from one's residence it is both difficult and cumbersome to carry necessary tooth care products such as a toothbrush, toothpaste, and dental floss. Whereas there are a number of compact and travel toothbrushes along with small tubes of toothpaste, it is difficult to store and lug these devices from place to place, especially in a setting where a luggage bag, purse or satchel is not readily accessible. Also, once used the toothbrush becomes wet, soiled and infectious making it even less desirable. Cylindrical or elongated brushes and tubes are protruding, bulky, and not cosmetically appropriate to carry one one's person away from their home, car, or hotel room. They are also expensive to replace after each use. Toothbrushes, while invaluable for health are not visually acceptable for public display. These items are also often forgotten or intentionally omitted by travelers, requiring inn keepers to keep a stock of these items in an effort to service their customers. While the guests may benefit from such an endeavor, the hotel often suffers by having to use precious storage space to supply these along with other sundries. Costs for these toiletries are also prohibitive. Few guests would find a partially used tube of toothpaste acceptable, yet at the same time would not finish the average small tube in a normal stay. Additionally, the innkeeper gains no promotional advantage in giving out any of these tooth care items other than possible the good will of having supplied the product. The length of a normal toothbrush may also make it too long to use in many dispensers or vending machines. Other cleaning adjuncts such as wipes, picks, etc. are compact but do not provide the thorough cleaning that is possible only by using a bristle brush.

Although the preferred embodiment of the four handle sections 25 is shown, those skilled in the art may appreciate that in varied configurations less or more handle sections may be used. The handle sections narrow at an angle to become brush heads, 25. The width shape and length of the brush heads, 25, may vary and are dependent of the desired shape, alignment and size of the device. Crease guides (aka living hinges) 30, are shown which assist in the symmetrical folding of the handle sections, 20. Raised tabs, 40, and tab slots 50 are shown and may be of circular, square, rectangular or of other design. These tabs and tab slots are arranged and aligned in such a manner that the raised tabs 40 insert into the tab slots, 50 and fit together tightly to allow the formation of stable structural support for the device. Bristles, 60 may be of single, double, triple, or more rows and may be preformed, attached, inserted or otherwise affixed into each section of the brush head, 25. Prior to assembly a storage space, 70 exists between each handle section. This storage space in the preferred embodiment will be used for the storage of a measured amount of toothpaste, powder or other cleaning agent, or a small spool of dental floss. These adjuncts may be packaged in such a manner as to fit neatly into the storage space 70 until needed by the consumer.

Figure 2:
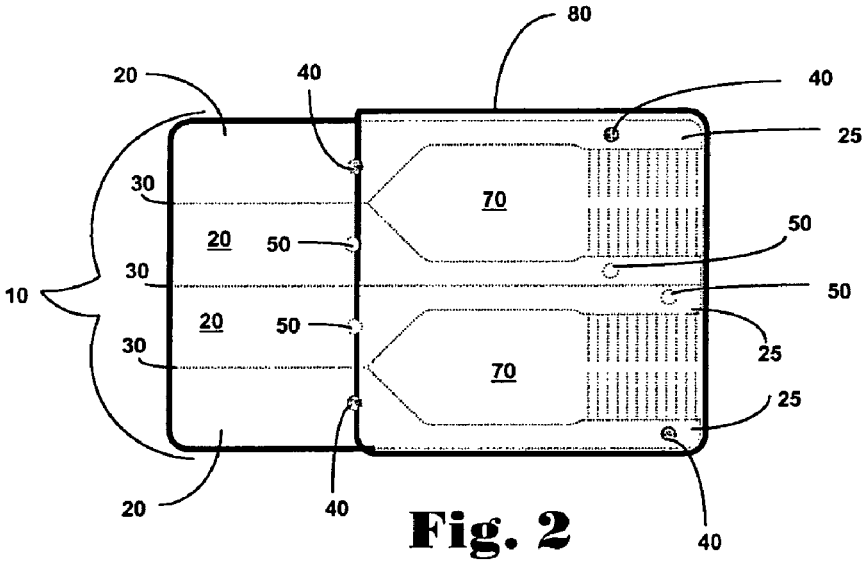

FIG. 2 depicts the device, 10 inserted into the cover 80. The cover in the preferred embodiment will be made of a material similar to those used in the device 10, and be aligned and attached in such a way as to conceal the raised tabs 40, tab slots, 50, brush heads 25, bristles 60, and storage space 70, along with any cleaning agent or floss. It should be noted that the handle section 20 angle and reduce in size and thickness at a point where they are enclosed by the cover 80 and align in such a manner as to form a uniform, smooth surface on all sides. Grooves may be cut into the interior of the cover 80 to allow raised tabs 40 to fit inside. These raised tabs 40 may also in certain embodiments act as a tension mechanism to hold the device 10 inside the cover 80 until it is separated by the user. When in place, the cover will allow for any logo, imprint or label to give the appearance of being a single piece. Other optional covers may include plastic or shrink wrap, vinyl, waxed paper, pulp paper or cardboard.

Figure 3:
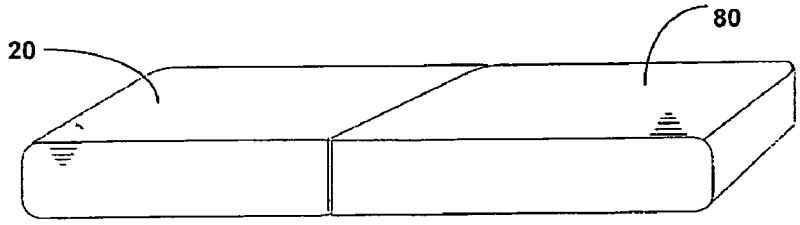

FIG. 3 depicts the device 10 with the cover, 80 in place. In this embodiment the handle sections 20 are visible and align with the cover 80 to provide a flat surface that is suitable for imprinting a logo, design, or border.

Figure 4:
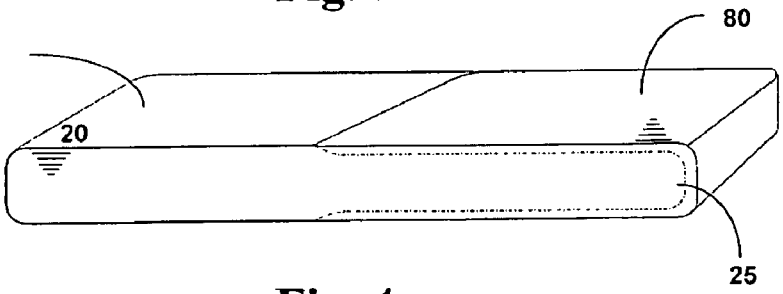

FIG. 4 depicts a side view of the device 10 with the handle section 20 visible and shows the position of the brush head 25 inside the cover 80.

Figure 5:
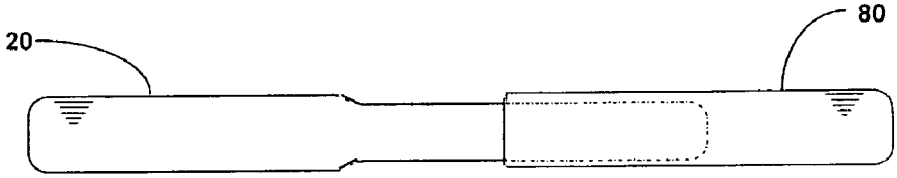

FIG. 5 depicts a side view of the device 10 with handle section 20 and brush head 25 partially revealed from cover 80.

Figure 6:
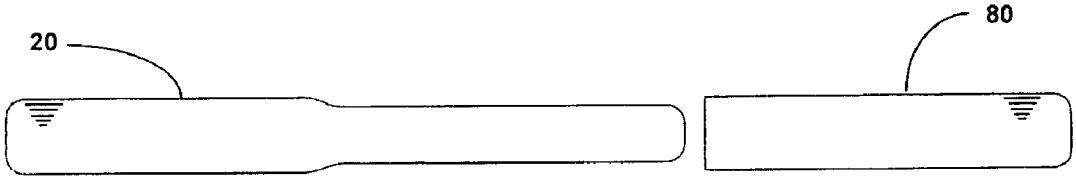

FIG. 6 depicts a side view of the device 10 removed from the cover 80 with handle section 20 and brush head 25 fully exposed.

Figure 7A:
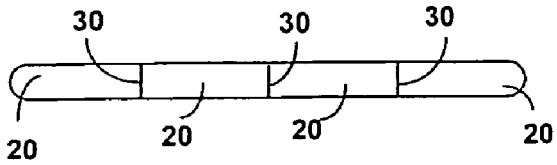

FIG. 7A depicts an end view of the handle sections 20 of the device 10 in preparation for assembly.

Figure 7B:
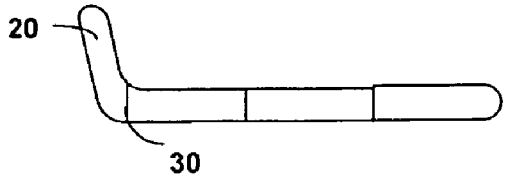

FIG. 7B depicts an end view of one outer handle section 20 folded upwardly along the crease 30.

Figure 7C:
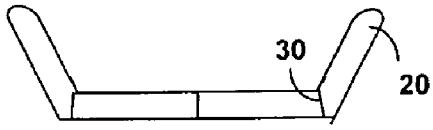

FIG. 7C depicts an end view of a second outer handle section 20 folded upwardly along crease 30.

Figure 7D:
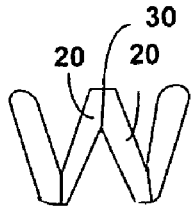

FIG. 7D depicts an end view of the two center handle sections 20 folded in a downward manner.

Figure 7E:
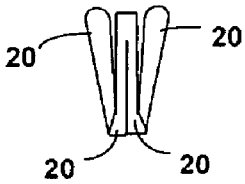

FIG. 7E depicts an end view of the handle sections 20 folded at the creases 30 in such a manner as all sections are aligned.

Figure 7F:
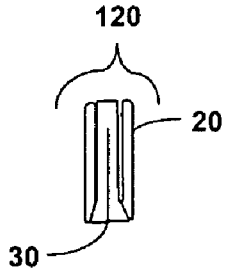

FIG. 7F depicts an end view of the unit fully assembled and held together in any manner e.g. adhesion, snaps, straps, etc.

Figure 8:
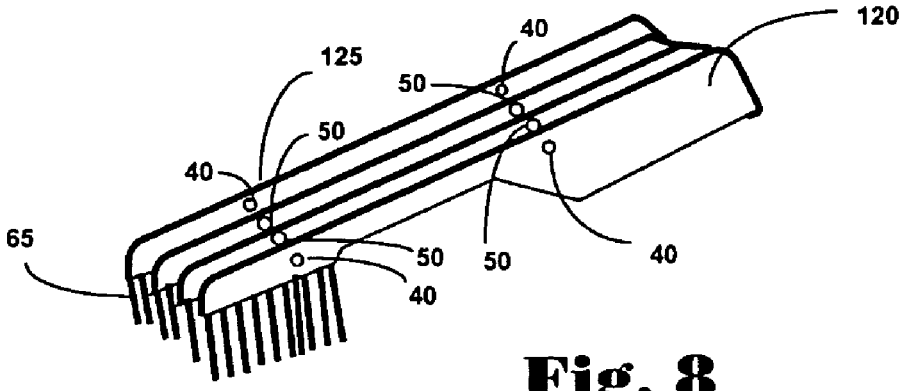

FIG. 8 is a side view of the device after the folding assembly is completed but prior to the completed assembly, with handle sections 20 aligned in such a manner as to align tabs 40 with tab holes 50 and create brush handle 120 and brush top 125.

Figure 9:
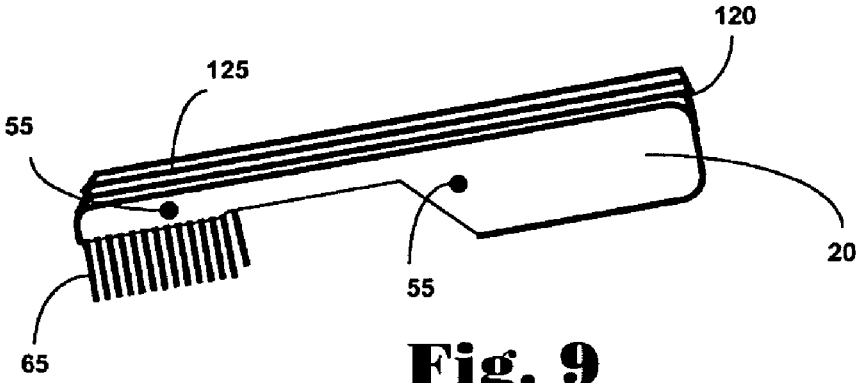

FIG. 9 is a side view of the final assembly; with raised tabs 40 inserted into tab slots 50 to become completed snap assembly 55 and stabilize brush handle 120 and brush top 125. These tabs provide both lateral and medial support for the brushcard allowing it to be used in the same manner as a typical toothbrush.

Figure 10:
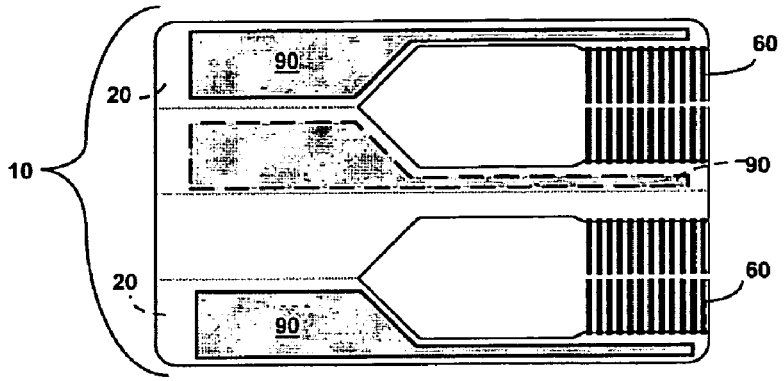

FIG. 10 depicts the device prior to assembly, with adhesive strips 90 attached. In a preferred embodiment these strips are adhered to the device in advantageous locations. A second side of each strip is exposed through the use of removable tabs, wrappers, or other means. These exposed adhesive strips make contact as handle sections 20 are folded and aligned in a manner such as the bristles 60 are contiguous and neighboring forming a brush head and handle.

Figure 11:
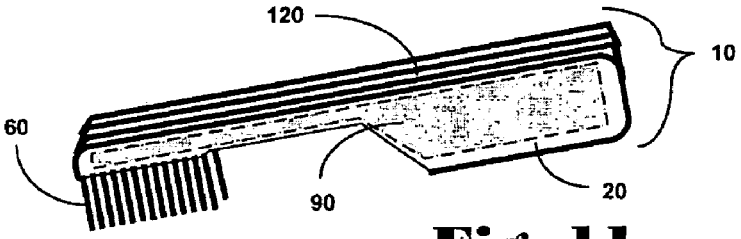

FIG. 11 depicts the device folded and held together by adhesive strips. The location of the strips are encompassed in the final assembly and set between handle sections 20 in such a manner so as no exposed strip remains after proper alignment and assembly, creating brush handle 120 and aligning all bristles 60 to form the desired number of bristle rows.

Figure 12:
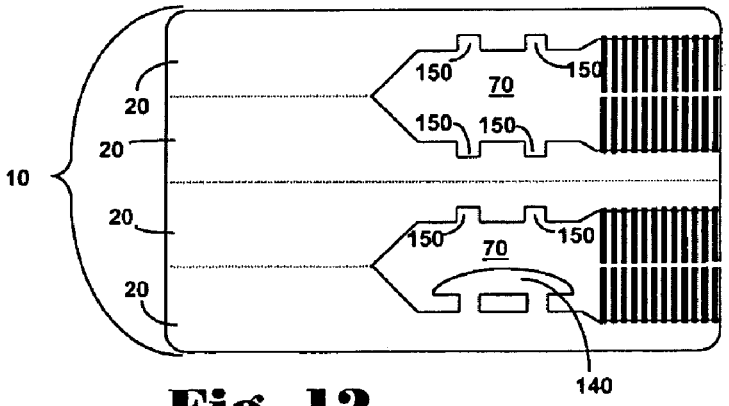

FIG. 12 depicts the device prior to assembly making use of inset tab cutouts 150 designed in such a manner as to be secured with bendable tab 140 when the unit is properly aligned. Tabs may be added or repositioned in such a manner as to form the desired assembly method and for strength purposes.

Figure 13:
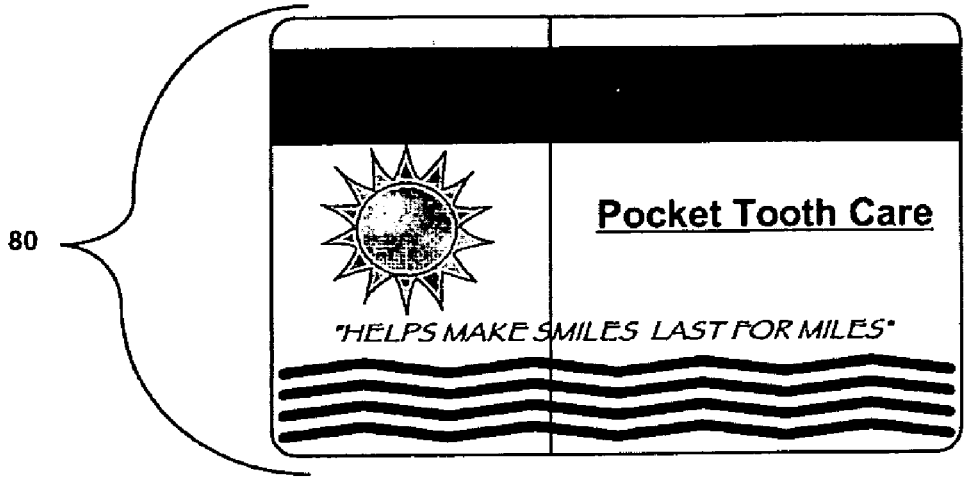

FIG. 13 depicts the cover 80 imprinted, stamped or labeled in such a manner as to resemble a credit card, room key, or similar item.

Figure 14:
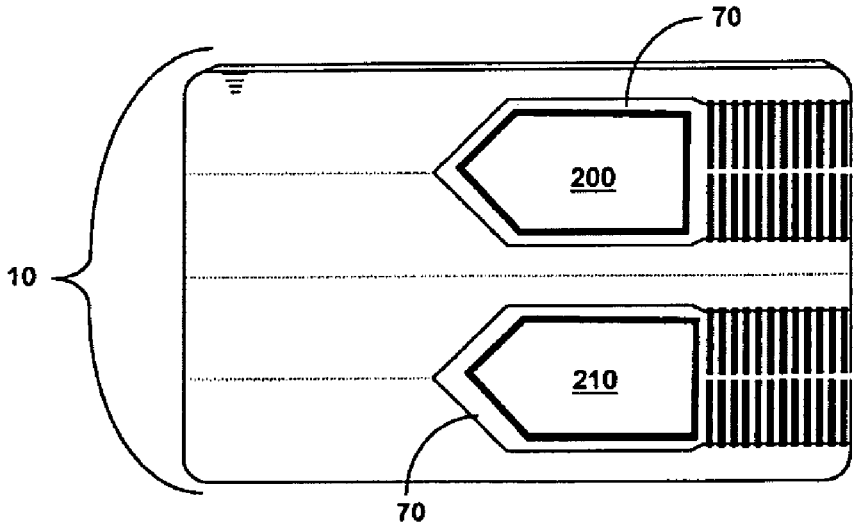

FIG. 14 depicts the device 10 prior to assembly and without any cover or packaging with a floss packet 200 and toothpaste packet 210 set inside of the storage area 70.

SUMMARY OF THE INVENTION

In one aspect, the present invention provides a brushcard of a planar member comprising a plurality of sections, each separated by lines of weakness, each section comprising a handle region and a bristle region. The planar member comprises at least one recess, and the member is configured to fold into a toothbrush. In some aspects the planar member comprises two, three, four or more sections, and can comprise a plurality of recesses, with two being of particular use. In further aspects, the planar member includes the use of at least one section, or strip, of adhesive to hold the sections together in the three dimensional toothbrush. In an additional aspect, one or more of the sections comprise a tab and at least one of said sections comprise a tab slot to hold said sections together in said toothbrush. Further aspects include the use of covers that may be lettered with instructions, advertising, etc.

In an additional aspect, the invention provides kits comprising a planar member and any one of an optional list of additional components, including, but not limited to, aliquots of tooth care products such as toothpaste, tooth powder, dental floss, mouthwash etc. The kits optionally comprise a cover and/or instructions.

DETAILED DESCRIPTION OF THE INVENTION

The present invention provides a "brushcard", which is planar until needed, lightweight, and completely portable. Through its planar design this toothbrush is received by the consumer in a form similar in size and shape to a common credit card. Yet it transforms easily to form a disposable toothbrush with handle. One or more recesses in the substrate allow for optional placement of a single use (e.g. foil wrapper) ration of toothpaste, dental floss, or other dental care adjunct. This unique design allows it to be stored in the most efficient manner without any adverse use of space. That it is similar in size and width to a common credit card it can easily be carried concealed on one's person (e.g. shirt pocket) without protruding. The benefits of such a device are obvious in social or business settings. Its shape, size and composition also allows it to be imprinted with a logo similar to and much in the way that a common credit card bears the mark of its issuer. This benefit the innkeeper who can have a promotional message or mark placed on the device, much in the way that a card key carries a corporate message. The card shape also allows for it to be dispensed through vending machines, in a candy rack or on the checkout counter. In other applications it can fit quickly into a lunchbox, be served with an airplane meal, or be included in an office food delivery. Should the device be exposed in a social setting it would be difficult to distinguish it as a toothbrush prior to assembly. Additional cost savings can be realized by providing an efficient, measured amount of toothpaste and floss to accompany each toothbrush.

Accordingly, the present invention provides a planar member with a plurality of sections. The planar member, also referred to herein as a "brushcard", may be made of any number of materials, including but not limited to, fiberglass, teflon, ceramics, glass, silicon, mica, any number of different plastics (including acrylics, polystyrene and copolymers of styrene and other materials, polypropylene, polyethylene, polybutylene, polycarbonate, polyurethanes, etc.), resins and other polymers; or any materials that would give the appearance, texture or size of a credit card. In certain other embodiments construction could be of cardboard, coated, waxed or pulp based paper, or a combination of material that allow it to be assembled and used as a toothbrush.

The planar substrate is divided into a plurality of sections, each separated by a line or weakness, sometimes also referred to as "crease guides" or "living hinges". In general this is a type of scoring, or thinning in the example of injection molded members, that allow easy folding of the planar member into a three dimensional device. In some embodiments the sections may be made independently and then attached, for example through tapes or other adhesives.

Each section of the planar member comprises a handle region and a bristle region, as is depicted in the figures. The bristles in one embodiment are formed or constructed out of polypropylene or similar material so as to allow the entire unit to be formed as a single unit e.g. injection molded. In other embodiments the bristles that ultimately form the brush are constructed of any number of materials, normally plastic materials, that are bound together in bundles and associated (e.g. glued) to the bristle portion of each section such that remain associated during use of the brushcard. In addition, bristles may be cut, channeled, chamfered, or shaped to allow the most efficient manner of dental cleaning, and may come in different stiffnesses (e.g. soft, medium, hard) depending on the consumer's desires.

Figure 1:
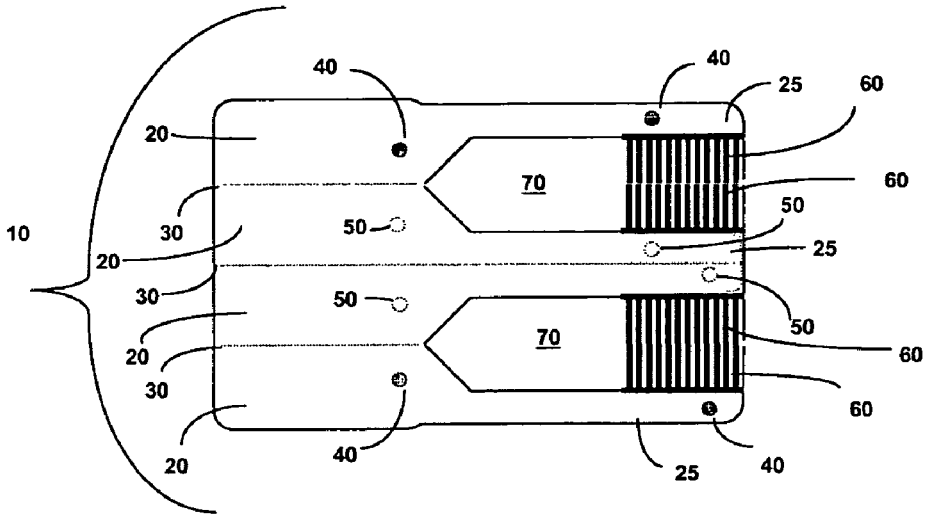
In FIG. 1 reference is made to the device, 10, shown prior to assembly and without any covering. The device has handle sections, 20, which may be exact or similar in design.

As may be seen, Applicant's FIG. 1 and FIGS. 7A-F, 8, 9 and 11 can be described as a toothbrush that is capable of transitioning between a flat credit card shape (FIG. 1 (10) and a three dimensional toothbrush shape (FIG. 9). This toothbrush has four handle sections (20). Each handle section (20) is foldably joined to an adjacent handle section (20) by a respective line of weakness (30), and each handle section includes both a handle region (20) and a bristle region (60) attached to a back support (25) (also called a "handle section"

in paragraph [0025]) that is an extension of the handle (20) and joins with the handle to form a substantially straight edge with the handle region. This back support (25) will be called a "bristle region back support". The bristles (60) are arranged in two pairs, where each member of a bristle pair (60) faces the other member of a bristle pair without a substantial gap. The two handles (20) positioned on the outer sides of the toothbrush are positioned so that the bristle region back supports (25) face outwards, and the bristles (60) attached to the bristle region back supports (25) face inwards.

The toothbrush is foldable between (i) a flat mode FIG. 1(10) in which an outer periphery of the toothbrush includes three uninterrupted peripheral sides formed by the sides of the handle sections that do not have bristle regions and the bristle region back supports. The periphery of the toothbrush, when flat, has the approximate size and shape of a credit card. When it is in its folded three dimensional toothbrush mode in which the four handle sections and bristle region back supports are folded against one another to form a brush handle and the plurality of bristle rows align and extend in one direction to form a brush head (FIG. 9(65)).

The brushcard usually includes one or more recesses (also referred to herein as "reservoirs", "storage spaces" or "wells") that serve several purposes. As depicted in the figures, the recesses generally allow the folded toothbrush to separate the bristle section from the handle section. In addition, the recess(es) can be used to store one or more aliquots of tooth care products. For example, small aliquots of toothpaste (including toothpaste, tooth powder or other tooth cleaning agents, for example in foil or plastic containers), mouthwash (including mouth care products such as LISTERINE®), dental floss (including small spools, threaders, etc), toothpicks, orthodontic care products (picks, brushes, etc.), or any other tooth cleaning or mouth freshening compounds. In additional embodiments, particularly when the planar thickness of the device is not of concern, these toothcare products need not reside within the recesses in the planar form, but instead are included within a kit as outlined herein.

In some embodiments, the recesses are present only after assembly; for example, in case where increased strength of the planar member is desired, the recesses may be filled with the substrate and "punched out" prior to assembly of the toothbrush. For example, recess 70 in the figures may actually be plastic, that is separated from the remainder of the planar member by small columns of plastic, which allows the user to "punch out" the recess and then assemble the device.

In one embodiment, the device may also allow for imprinting, stamping, or the adhering of a logo or design. This can be done in a variety of ways. In one embodiment, the kit comprises a cover can be made of any disposable materials, including the materials outlined herein for the member, including plastics, such as a plastic wrapper or shrink wrap, vinyl, waxed paper, cardboard, etc. In some embodiments, a thin cover is designed to slide over all or part of the brushcard, with the two components being configured to slide apart; other embodiments utilize a "wrapper" type configuration where the cover is peeled/pulled off of the brushcard. This may be particularly useful when certain adhesives are used. Similarly, a clear plastic wrapper can be used. Separate printed instructions can also be optionally included in the kits.

The cover can be imprinted, embossed, labeled, etc. with instructions, advertising, logos, etc. or any combination thereof. In some cases, the lettering and/or pictures can be molded as part of the brushcard, or can be applied later.

The brushcard is assembled by folding, bending or connecting in any manner that configures the device to look and perform as a toothbrush. The sections of the device are held together after folding in any manner so as to form a single unit. Thus, in one embodiment, the folded sections are held together using adhesive on one or more of the sections. Thus, the device can be held together using an adhesive section or strip. As will be appreciated by those in the art, any number of suitable adhesives can be used, including glues, reversible adhesives, gums, pressure sensitive adhesives, etc. One embodiment utilizes approved by the FDA for use in the mouth, e.g. denture adhesives. For example, suitable dental adhesives include, but are not limited to, Karaya and sodium borate with or without acacia denture adhesive, ethylene oxide homopolymer and or carboxymethylcellulose sodium denture adhesive, carboxymethylcellulose sodium and cationic polyacrylamide polymer denture adhesive, ethylene oxide homopolymer and or karaya denture adhesive, polyacrylamide polymer (modified cationic) denture adhesive, carboxymethylcellulose sodium and or polyvinylmethylether maleic acid calcium-sodium double salt denture adhesive, polyvinylmethylether maleic anyhydride (PVM-MA), acid copolymer, and carboxymethylcellulose sodium (NACMC) denture adhesive. In some cases, the adhesive is a rubber, silicon or gel strip that adheres the sections together.

In other embodiments the device may snap, insert, align or connect together or be formed using a combination of methods and attachments. For example, in one embodiment, one or more of the sections comprises tabs and tab holders that are used to snap the device into a three dimensional toothbrush. Additional methods of securing the assembled device may include a strap, hinge, sleeve, band e.g. rubber, lock or pin. In some cases, the brushcard does not utilize particular holding means but instead relies on the user to hold it together during use.

FIG. 12 shows that the flat credit-card shaped toothbrush may be held further held into its three dimensional toothbrush position by a bendable tab (140) positioned on one handle section (20) on one side of the toothbrush. Here all of the other handle sections have inset tab cutouts (150). Thus when the various handle sections (20) are folded against one another, the tab (140) may be repositioned to add strength to the three dimensional toothbrush assembly.

Additional explanations and expansions of the invention are made by reference to the figures.

The invention claimed is:

1. A toothbrush capable of transitioning between a flat credit card shape and a three dimensional toothbrush shape, comprising:

four handle sections, each handle section foldably joined to an adjacent handle section by a respective line of weakness, and each handle section including a handle region and a bristle region attached to a back support (bristle region back support) that is an extension of the handle and joins with the handle to form a straight edge with said handle region; and four bristle rows, each bristle row extending from the bristle region of a respective handle section;

wherein the toothbrush is foldable between (i) a flat mode in which an outer periphery of the toothbrush includes three uninterrupted peripheral sides formed by the sides of the handle sections that do not have bristle regions and the bristle region back supports;

said bristles being arranged in two sets of bristle pairs, wherein each member of a bristle pair faces the other member of a bristle pair without a substantial gap;

said handles on the outer sides of the toothbrush being positioned so that the bristle region back support faces outwards, and the bristles attached to the bristle region backs face inwards;

said toothbrush having the approximate size and shape of a credit card when flat, and (ii) a folded three dimensional toothbrush mode in which the four handle sections and bristle region back supports are folded against one another to form a brush handle and the plurality of bristle rows align and extend in one direction to form a brush head.

2. A toothbrush according to claim 1 further comprising at least one strip of adhesive to hold adjacent handle sections together when the toothbrush is in the folded mode.

3. A toothbrush according to claim 1 wherein at least one of said handle sections on one side of said periphery comprises a bendable tab and wherein all other said handle sections have inset tab cutouts wherein when the four handle sections are folded against one another, the tab may be repositioned to add strength to the three dimensional toothbrush assembly.

4. A toothbrush according to claim 1 further comprising a cover.

5. A toothbrush according to claim 1 wherein said cover comprises writing selected from the group consisting of instructions and advertising.

6. The toothbrush of claim 1, in which the three dimensional toothbrush may be assembled by making only three folds.

7. A kit comprising:

a) a toothbrush according to claim 1; and b) an aliquot of tooth care product;

wherein said aliquot of tooth care product is selected from the group consisting of toothpaste, dental floss, and mouthwash.

8. A kit according to claim 7 further comprising a cover.

9. A kit according to claim 8 wherein said cover comprises writing selected from the group consisting of instructions and advertising.

10. A toothbrush capable of transitioning between a flat credit card shape and a three dimensional toothbrush shape, comprising:

four handle sections, each handle section foldably joined to an adjacent handle section by a respective line of weakness, and each handle section including a handle region and a bristle region attached to a back support (bristle region back support) that is an extension of the handle and joins with the handle to form a straight edge with said handle region; and four bristle rows, each bristle row extending from the bristle region of a respective handle section;

wherein the toothbrush is foldable between (i) a flat mode in which an outer periphery of the toothbrush includes three uninterrupted peripheral sides formed by the sides of the handle sections that do not have bristle regions and the bristle region back supports;

said bristles being arranged in two sets of bristle pairs, wherein each member of a bristle pair faces the other member of a bristle pair without a substantial gap;

said handles on the outer sides of the toothbrush being positioned so that the bristle region back support faces outwards, and the bristles attached to the bristle region backs face inwards;

said toothbrush having the approximate size and shape of a credit card when flat, and (ii) a folded three dimensional toothbrush mode in which the four handle sections and bristle region back supports are folded against one another to form a brush handle and the plurality of bristle rows align and extend in one direction to form a brush head;

further comprising a bendable tab positioned on one handle section on one side of said toothbrush, and wherein all other said handle sections have inset tab cutouts, wherein when the four handle sections are folded against one another, the tab may be repositioned to add strength to the three dimensional toothbrush assembly.

11. The toothbrush of claim 10, in which the three dimensional toothbrush may be assembled by making only three folds.

* * * * *